US007293912B2

(12) United States Patent
Girardin et al.

(10) Patent No.: US 7,293,912 B2
(45) Date of Patent: Nov. 13, 2007

(54) TIMEPIECE WITH A CONSTANT-FORCE DEVICE FOR ACTING ON AN OSCILLATING SYSTEM

(75) Inventors: Johnny Frédéric Girardin, La Chaux-de-Fonds (CH); Stephen Edward Methuen Forsey, Le Locle (CH)

(73) Assignee: Lange Uhren GmbH, Glashuette (DE)

( * ) Notice: Subject to any disclaimer, the term of this patent is extended or adjusted under 35 U.S.C. 154(b) by 0 days.

(21) Appl. No.: 11/634,654

(22) Filed: Dec. 6, 2006

(65) Prior Publication Data

US 2007/0147179 A1 Jun. 28, 2007

(30) Foreign Application Priority Data

Dec. 7, 2005 (DE) ..... 10 2005 058 321

(51) Int. Cl.
*G04B 25/00* (2006.01)
*G04B 5/00* (2006.01)

(52) U.S. Cl. ..... 368/151; 368/207

(58) Field of Classification Search ..... 368/140, 368/147–151, 206, 207, 208
See application file for complete search history.

(56) References Cited

U.S. PATENT DOCUMENTS 240,287 A * 4/1881 Vogel ..... 368/151
1,125,617 A * 1/1915 Wilkinson ..... 368/151
1,237,216 A * 8/1917 Oeth ..... 368/151
1,385,351 A * 7/1921 Akerlund ..... 368/151
1,475,629 A * 11/1923 Haynes ..... 368/151
1,611,568 A * 12/1926 Standow ..... 368/151
6,863,434 B2 3/2005 Mojon
6,997,602 B2 2/2006 Mojon et al.

FOREIGN PATENT DOCUMENTS

CH 120028 8/1927

OTHER PUBLICATIONS

Examination Report dated Jan. 11, 2007 issued for the corresponding German Application No. 10 2005 058 321.0-31.

* cited by examiner

*Primary Examiner*—Vit W Miska
(74) *Attorney, Agent, or Firm*—Cohen Pontani Lieberman & Pavane LLP

(57) ABSTRACT

A timepiece, in particular a wristwatch, includes a constant-force device for acting on an oscillating system, the constant-force device including a switching unit and a tensioning module having a primary spring-energy store and a secondary spring-energy store. A seconds shaft bearing a seconds wheel and a cam plate is driven to rotate constantly by the secondary spring-energy store. The seconds wheel drives the oscillating system, and the cam plate acts on the switching unit for the periodic tensioning of the secondary spring-energy store by the primary spring-energy store.

17 Claims, 3 Drawing Sheets

TIMEPIECE WITH A CONSTANT-FORCE DEVICE FOR ACTING ON AN OSCILLATING SYSTEM

BACKGROUND OF THE INVENTION

1. Field of the Invention

The invention relates to a timepiece, in particular a wristwatch with a constant-force device for acting on an oscillating system, the constant force device having a switching unit and a tensioning module.

2. Description of the Related Art

The switching unit periodically controls tensioning of a secondary spring-energy store of the tensioning module by a spring barrel forming a primary spring-energy store, the periodic control of the switching unit taking place by means of a cam plate which can be driven in a permanently rotatable manner.

By virtue of such constant-force devices, the primary spring-energy store, rather than acting directly on the oscillating system, periodically tensions the secondary spring-energy store, which then acts on the oscillating system.

The level of force acting on the oscillating system is thus, to the greatest possible extent, constant, which results in a high level of accuracy for the timepiece.

A known timepiece with a constant-force device has the problem of a high level of force being lost over the transmission path from the primary spring-energy store to the secondary spring-energy store, which also drives the cam plate, so that the torque acting on the cam plate is relatively low.

In order to achieve a sufficient torque, the initial force of the primary spring-energy store therefore has to be set at a high level.

SUMMARY OF THE INVENTION

The object of the invention is thus to provide a timepiece of the type mentioned in the introduction in which, with low outlay, the cam plate is subjected to a high torque.

This object is achieved with a seconds shaft driven in a rotatable manner by the secondary spring-energy store, the seconds shaft bearing the cam plate and a seconds wheel, which drives the oscillating system.

This design results in a largely direct transfer of force from the primary spring-energy store to the secondary spring-energy store, so that the cam plate is subjected to a high torque. The latter ensures reliable switching of the switching unit.

The switching unit preferably has a stop wheel which can be driven in a rotatable manner about a stop wheel axis by way of the spring barrel, in particular via a third wheel. The stop wheel has one or more radial teeth in which a pallet of a rocker, which can be pivoted about an oscillating axis parallel to the stop wheel axis, can be engaged radially so as to block a rotary movement of the stop wheel. The rocker has a claw which engages around a cam plate having one or more radially projecting lobes, the claw being pivoted periodically by the rotary movement of the cam plate, as a result of which the pallet can be disengaged from the radial tooth.

A largely direct transfer of force from the spring barrel to the secondary spring-energy store is achieved in a manner which is straightforward and reduces the amount of installation space required if an intermediate tube which is coaxial with the seconds shaft is driven in a rotatable manner by way of the spring barrel, in particular via a third wheel. The intermediate tube has a drive wheel, for driving the stop wheel in a rotatable manner, and a retaining plate, which is connected to the secondary spring-energy store.

If the drive wheel drives the stop wheel in a rotatable manner via a transmission gear mechanism, this results in the tooth of the stop wheel acting on the pallet of the rocker with a relatively low level of force, so that the relative movement between tooth and pallet results in just low frictional forces, which have to be overcome by the cam plate during the pivoting movement of the rocker.

In order to reduce the amount of installation space required, the intermediate tube can enclose the seconds arbor coaxially.

A compact construction is likewise the result if the secondary spring-energy store is a spiral spring which surrounds the seconds shaft coaxially and has its radially inner end fastened on the seconds arbor and its radially outer end fastened on the retaining plate.

For this purpose, the retaining plate may bear a stud, on which the radially outer end of the shaft spring is fastened.

An escape wheel of the oscillating system can be driven in a rotatable manner by the seconds wheel.

The seconds shaft bears a second hand.

The rocker is preferably mounted, by way of its one end region, such that it can be pivoted about the oscillating axis, has the claw at its other end region, and surrounds the stop wheel radially, at a distance therefrom, by way of its central region. The rocker has one or more pallets which project radially in relation to the stop wheel and, by virtue of the rocker being pivoted, can be moved radially into the rotary path of the tooth or of the teeth of the stop wheel.

In order to reduce the loss of force incurred for actuating the switching unit, the claw may have a friction-reducing coating on its surfaces which are subjected to the action of the lobes of the cam plate.

A flat construction is achieved if the rocker, stop wheel and cam plate are arranged to extend in a single plane.

In this case, the stop wheel axis preferably intersects a straight line between the seconds shaft axis and the oscillating axis.

A large pivoting path for the pallets is achieved if the spacing between the stop wheel axis and the oscillating axis is greater than the spacing between the stop wheel axis and the seconds shaft axis.

The rotary movement of the stop wheel shaft is damped, and the situation where the tooth strikes violently against the pallet is avoided, if the stop wheel is connected to a braking device which damps the rotary movement of the stop wheel.

For this purpose, an eddy current brake can be driven in a straightforward and wear-free manner by the drive train leading to the stop wheel, it being possible for the eddy current brake to have a brake axle which can be driven in a rotatable manner and has radially directed braking vanes.

An exemplary embodiment of the invention is described in more detail hereinbelow and illustrated in the drawing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 2:
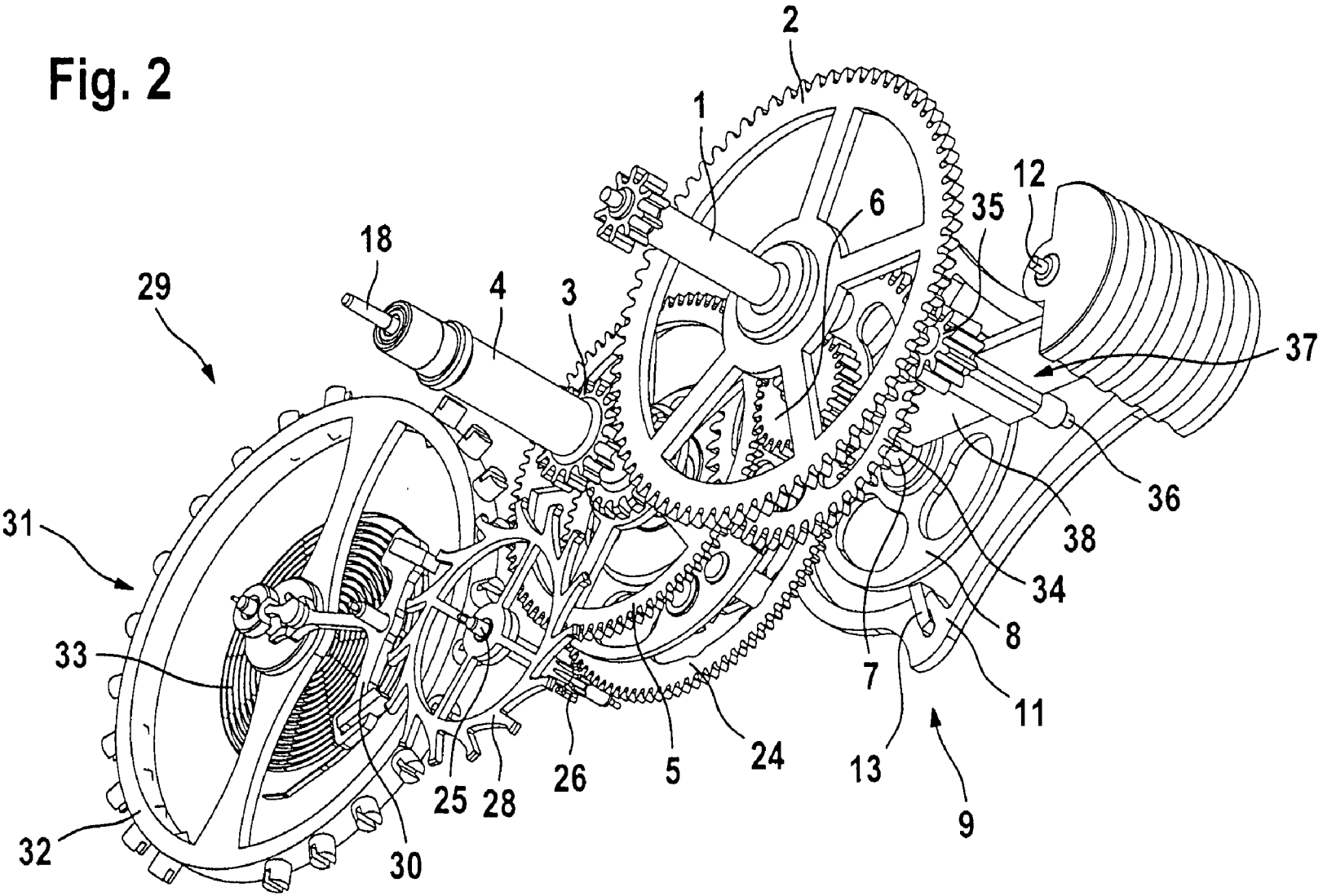
FIG. 2 shows, in perspective, a rear view of the region according to FIG. 1.
Figure 3:
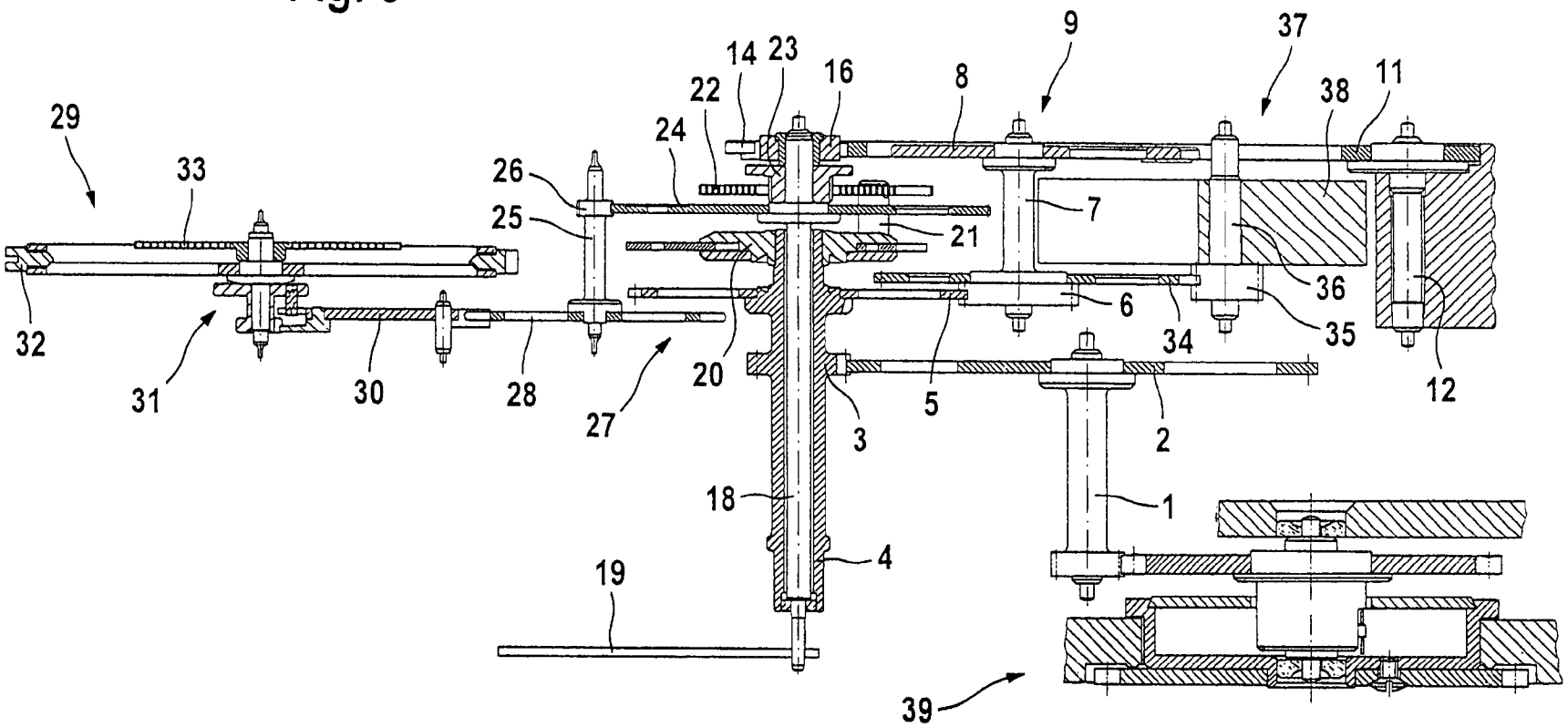
FIG. 3 shows a cross section of the region according to FIG. 1.

Referring to FIGS. 2 and 3, a third-wheel shaft 1 is subjected to rotary tensioning by way of a spring barrel 39.

The third wheel 2, which is fixed on the third-wheel shaft 1, is in engagement with a transmission wheel 3, which is fixed on a 10-seconds tube 4.

Figure 1:
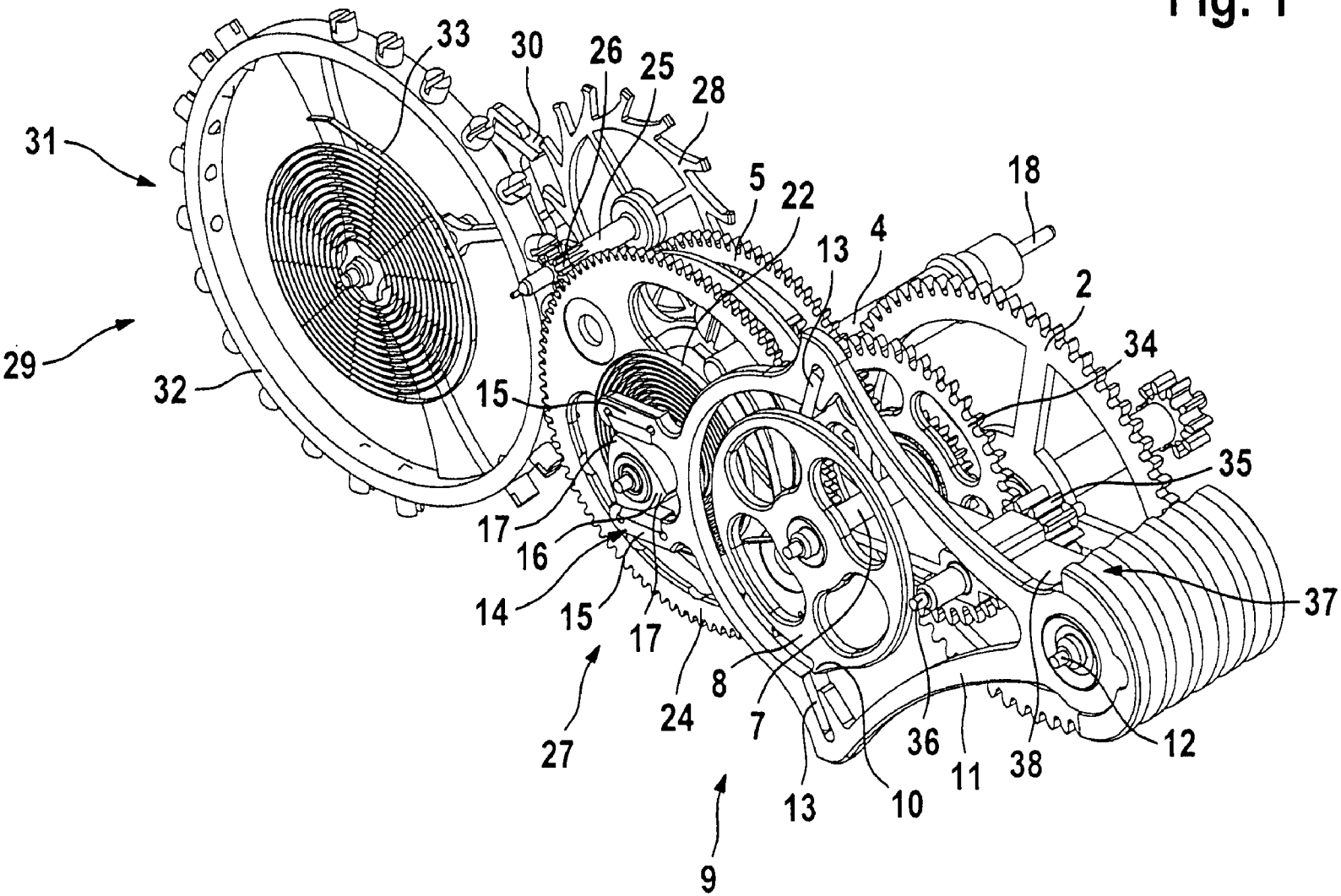
FIG. 1 shows, in perspective, a front view of that region of a timepiece which has a constant-force device.

Referring also to FIG. 1, a 10-seconds wheel 5, which is likewise fixed on the 10-seconds tube 4, transmits a rotary movement of the 10-seconds tube 4 to a stop wheel pinion 6, which is fixed on a stop wheel shaft 7, a stop wheel 8 of a switching unit 9 also being fixed on the stop wheel shaft 7.

The stop wheel 8 has a radially projecting tooth 10 on its circumferential surface.

Located in the same plane as the stop wheel 8 is a rocker 11, which can be pivoted about an oscillating axis 12 parallel to the axis of rotation of the stop wheel shaft 7.

The rocker 11 is designed to engage around the stop wheel 8, at a radial distance therefrom, and has two pallets 13 which are located approximately diametrically opposite one another and project radially in the direction of the stop wheel 8.

The spacing between the two pallets 13 is such that one of the pallets 13 projects radially into the rotary path of the tooth 10 and blocks a rotary movement of the stop wheel 8 when the tooth 10 butts against this pallet 13, while the other pallet 13 is located outside the rotary path of the tooth 10.

On that side of the stop wheel 8 which is located opposite the oscillating axis 12, the rocker 11 has a fork-like claw 14. This claw 14 uses its claw arms 15 to engage around a cam plate 16 with three radially projecting lobes 17.

The cam plate 16 is fixed at one end of a seconds shaft 18, which extends coaxially through the 10-seconds tube 4 and bears a second hand 19 at its other, free end.

Referring to FIG. 3, a retaining plate 20 of a tensioning module 27 is fastened on the 10-seconds tube 4 at the cam plate end of the latter, the retaining plate bearing, on its radially outer region, an axially projecting stud 21, which projects axially to the side of the cam plate 16.

The outer end of a spiral spring 22, which encloses the seconds shaft 18 at a distance therefrom, is fastened at the axially free end of the stud 21, while the inner end of the spiral spring 22 is fastened on the second hand 19 via a retaining part 23.

Axially between the retaining part 23 and the retaining plate 20, the seconds shaft 18 bears a seconds wheel 24, which transmits the rotary movement of the seconds shaft 18 to an escape-wheel pinion 26 arranged on a pallet shaft 25.

Also seated on the pallet shaft 25 is an escape wheel 28 of an oscillating system 29, this being designed as a Swiss lever escapement with pallet 30 and balance wheel 31 having a balance rim 32 and balance spring 33.

Also arranged on the stop wheel shaft 7 is an intermediate braking wheel 34, which engages in a pinion 35 of an eddy current brake 37, the pinion 35 being seated on a brake axle 36.

Furthermore, radially directed braking vanes 38 are arranged on the brake axle 36.

The device functions as follows:

The 10-seconds tube 4 is subjected to rotary tensioning by way of the spring barrel 39, via the third wheel 2.

One of the pallets 13 normally engages behind the tooth 10 of the stop wheel 8 and thus blocks the same.

The tensioned spiral spring 22 drives the oscillating system 29 via the seconds shaft 18 and rotates the cam plate 16 at a speed of 1 revolution per minute.

The lobes 17 of the cam plate 16 here butt against the arms 15 of the claw 14 of the rocker 11 and deflect the same in a pivoting direction in which the one pallet 13 is disengaged to an increasing extent from the tooth 10, until the tooth 10 is fully released from the pallet. This results in the 10-seconds tube 4 rotating through an angle of rotation of 60° and in the stud 21 thus pivoting via the retaining plate 20, so that the shaft spring 22 is pretensioned.

At the same time, as a result of the rotation of the 10-seconds tube 4, via the 10-seconds wheel 5, the stop wheel 8, now released from the one pallet 13, is rotated until the tooth 10, following a rotation of 180°, comes into abutment against the other pallet 13, which, by virtue of the rocker 11 being pivoted, has passed into the rotary path of the tooth 10. The device is then located in the normal position again.

After ten seconds, the rocker 11 has been pivoted into its opposite end position by the lobes 17 of the cam plate 16 and releases the tooth 10 again by way of the pallet 13, this resulting in the spiral spring 22 being pretensioned again, as described above.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A timepiece comprising constant-force device for acting on an oscillating system, the constant-force device comprising:

a primary spring-energy store comprising a spring barrel;

a secondary spring-energy store;

a seconds shaft that can be driven to rotate constantly about a second shaft axis by the secondary spring-energy store;

a seconds wheel borne by the seconds shaft for driving the oscillating system;

a cam plate borne by the seconds shaft; and a switching unit acted upon by the cam plate for the periodic tensioning of the secondary spring-energy store by the primary spring-energy store.

2. The timepiece of claim 1 wherein the switching unit comprises:

a stop wheel which can be driven by the spring barrel to rotate about a stop wheel axis, the stop wheel a radial tooth; and a rocker which can pivot about a pivot axis which is parallel to the stop wheel axis, the rocker having at least one pallet which can engage the radial tooth to block rotation of the stop wheel, and a claw which engages around the cam plate, wherein the cam plate has at least one lobe which pivots the rocker periodically as the cam plate rotates so that the pallet disengages the radial tooth.

3. The timepiece of claim 2 wherein the switching unit further comprises:

an intermediate tube which is coaxial with the seconds shaft and is driven by the spring barrel to rotate;

a drive wheel borne by the intermediate tube for driving the stop wheel to rotate; and a retaining plate borne by the intermediate tube and connected to the secondary spring-energy store.

4. The timepiece of claim 3 wherein the switching unit further comprises a transmission gear between the drive wheel and the stop wheel.

5. The timepiece of claim 3 wherein the intermediate tube surrounds the seconds shaft coaxially.

6. The timepiece of claim 3 wherein the secondary spring-energy store is a spiral spring which surrounds the seconds shaft coaxially, the spiral spring having a radially inner end fastened to the seconds shaft and a radially outer end fastened to the retaining plate.

7. The timepiece of claim 6 further comprising a stud fixed to the retaining plate, the radially outer end of the spiral spring being fastened to the stud.

8. The timepiece of claim 1 further comprising an escape wheel for driving the oscillating system, the escape wheel being driven to rotate by the seconds wheel.

9. The timepiece of claim 1 further comprising a second hand borne by the seconds shaft.

10. The timepiece of claim 2 wherein the rocker has one end region which pivots about the pivot axis, an opposite end region with the claw, and a central region surrounding the stop wheel radially and spaced therefrom, the at least one pallet projecting radially into the central region and being moved radially into the path of the tooth of the stop wheel as the rocker pivots.

11. The timepiece of claim 2 wherein the claw has surfaces which contact the lobes of the cam plate, said surfaces having a friction-reducing coating.

12. The timepiece of claim 2 wherein the stop wheel and the cam plate are substantially coplanar.

13. The timepiece of claim 2 wherein the stop wheel axis lies on a straight line between the pivot axis and the axis of the seconds shaft.

14. The timepiece of claim 13 wherein the stop wheel axis is closer to the second shaft axis than to the pivot axis.

15. The timepiece of claim 2 further comprising a braking device connected to the stop wheel for damping rotation of the stop wheel.

16. The timepiece of claim 15 further comprising a drive train between the spring barrel and the stop wheel, the braking device comprising an eddy current brake driven by the drive train.

17. The timepiece of claim 16 wherein the eddy current brake comprises a brake axle which is driven to rotate by the drive train, and a plurality of braking vanes extending radially from the brake axle.

* * * * *